United States Patent [19]

Lin

[11] Patent Number: 5,022,533

[45] Date of Patent: Jun. 11, 1991

[54] MOVING DISPLAY RACK

[76] Inventor: Yung-Chi Lin, No. 127, Shih Chia Tung Hsiang, East District, Taichung, Taiwan

[21] Appl. No.: 433,252

[22] Filed: Nov. 8, 1989

[51] Int. Cl.[5] ..... A47F 3/08

[52] U.S. Cl. ..... 211/1.5; 40/411; 40/414; 108/20

[58] Field of Search ..... 211/1.5, 186, 188, 144; 40/414, 411, 429, 614; 446/278, 487, 175, 3; 272/8 N, 1 GG, 1 GF; 108/91, 92, 94, 20

[56] References Cited

U.S. PATENT DOCUMENTS

| | | | |
|---|---|---|---|
| 944,969 | 12/1909 | Newman et al. | 211/1.5 X |
| 2,709,004 | 5/1955 | Dahlstrom | 108/20 |
| 2,997,181 | 8/1961 | Winn | 211/1.5 |
| 4,180,932 | 1/1980 | Millard | 40/411 X |
| 4,901,458 | 2/1990 | Belokin et al. | 40/414 |

FOREIGN PATENT DOCUMENTS

| | | | |
|---|---|---|---|
| 2607690 | 6/1988 | France | 211/1.5 |
| 0007081 | 4/1899 | United Kingdom | 211/1.5 |

*Primary Examiner*—Carl D. Friedman
*Assistant Examiner*—Daniel Hulseberg
*Attorney, Agent, or Firm*—Varndell Legal Group

[57] ABSTRACT

A moving display rack includes a plurality of generally bow shaped link rods used to secure a plurality of bearing boards, which are disposed at different level positions, to a base by means of fastening plates and bushings. During display, the motor which is set in the base drives the link rods to carry the bearing boards to rotate horizontally, so as to attract visitors' attention.

4 Claims, 4 Drawing Sheets

MOVING DISPLAY RACK

BACKGROUND OF THE INVENTION

The present invention is related to a kind of display rack and more particularly to a moving display rack for display of commercial articles.

The display rack is a framework for displaying commercial articles to attract customers to buy, and commonly used in department stores book stores, exhibition centers etc. Regular display racks are not movable when they are built up. Therefore, the effect of display can not be very attractive.

The present invention is to provide a moving display rack. Through the motion of display boards, which is carried to rotate by link rods through a motor set in the base of the display rack, the commercial articles displayed thereon can be more prominent and attractive.

Embodiments of the invention will now be described by way of example, reference been made to the annexed drawings in which:

DETAILED DESCRIPTION OF THE PRESENT INVENTION

Figure 1:
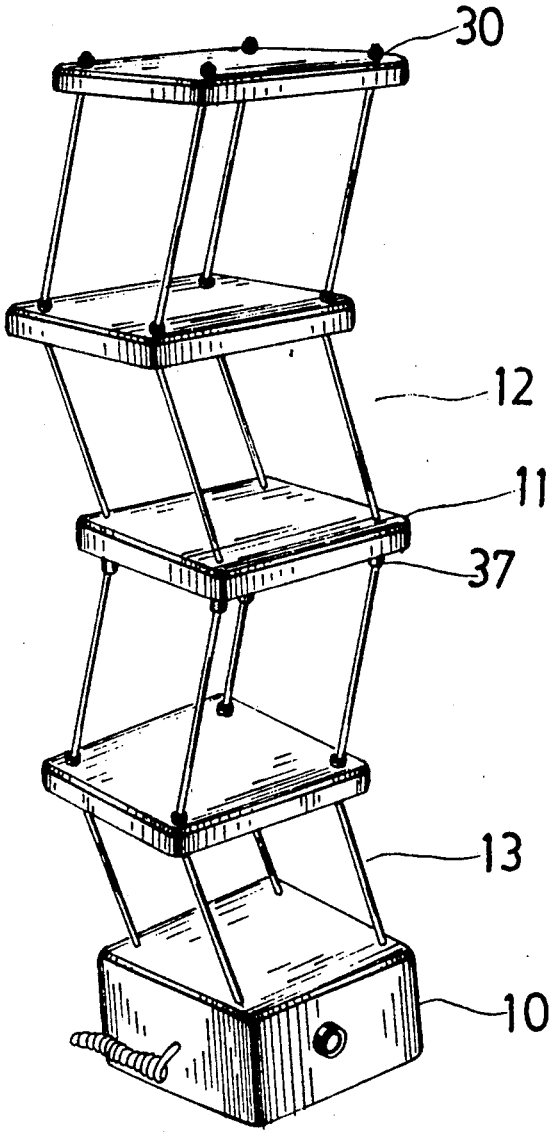
FIG. 1 is a perspective view of a moving display rack embodying the present invention.

Turning now to the annexed drawings in greater detail and considering first FIG. 1 there is shown an embodiment of a moving display rack, in accordance with the present invention, generally comprised of a plurality of bearing boards (11) movably mounted on a base (10) by means of two link rod assembly sets (12) and (13).

Figure 3:
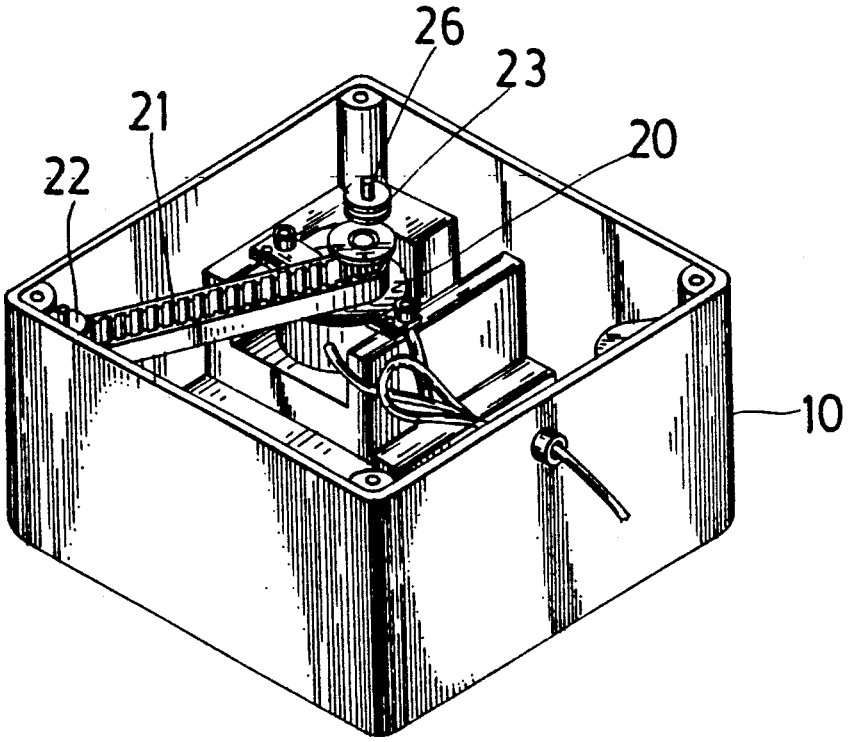
FIG. 3 is a perspective view of the structure shown in FIG. 4.
Figure 4:
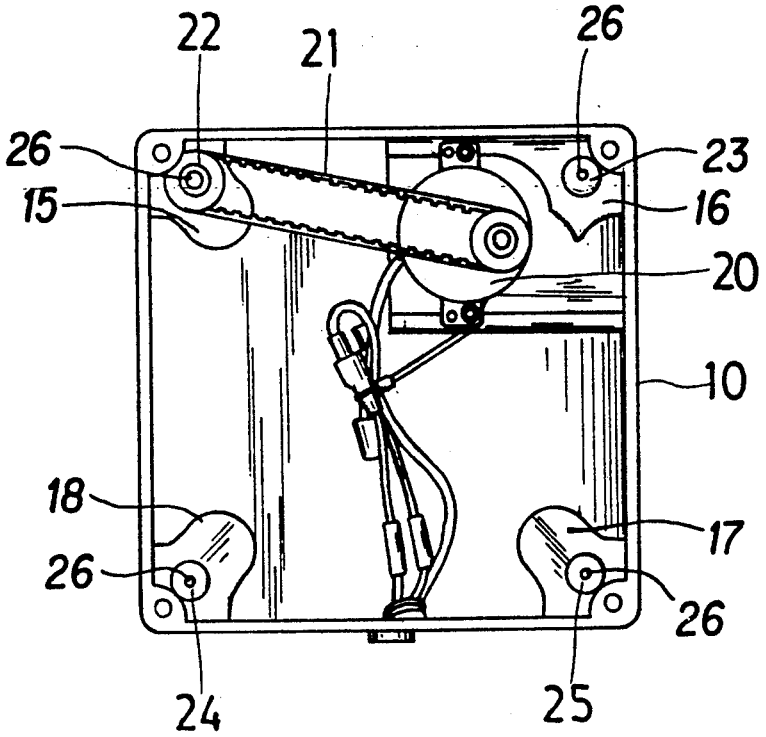
FIG. 4 is a bottom view of the base.

Referring to FIGS. 3 and 4, the base (10) has a case-like structure comprising therein three positioning plates (23), (24) and (25), a motor (20) and a driving belt (21) which engages a driven wheel (22) is revolvable and carried to rotate by the motor (20) through the driving belt (21).

Figure 2:
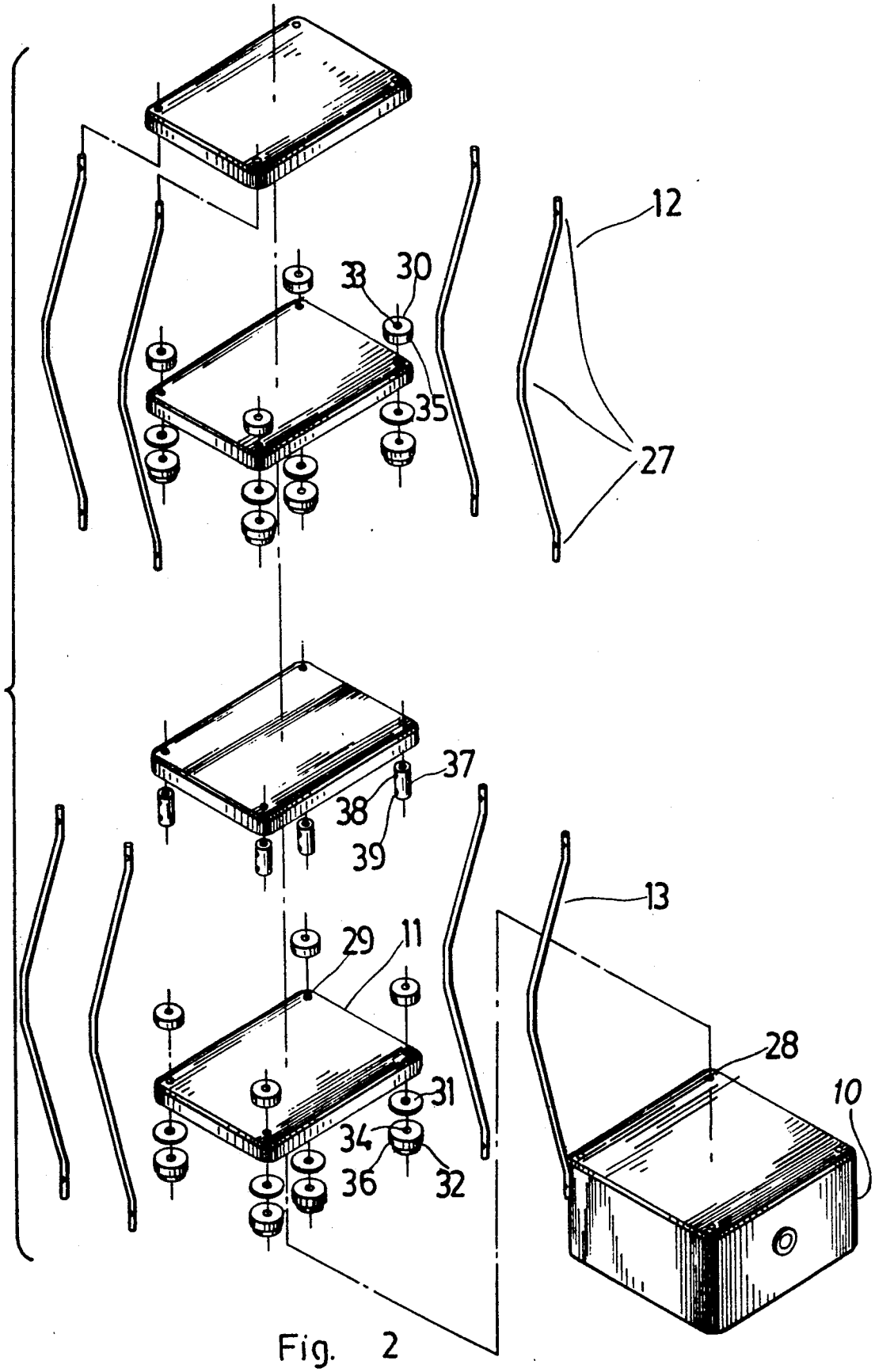
FIG. 2 is a perspective fragmentary view of the present invention.

Referring to FIGS. 1 and 2, the two link rod assembly sets, i.e. the upper link rod assembly (12) and the lower link rod assembly (13) each is comprised of a plurality of generally bow shaped rods (in this embodiment, the number of rods for each link rod assembly is (4) of which each comprises three vertical segments (27), i.e. one in the middle and two at both ends. The lower ends of the four rods 13 of the lower ink rod assembly are inserted through four corresponding through-holes 28 in the top cover of the base at the corners thereof. The rods 13 extend downwardly and are rotatable with respect to seats 15, 16, 17 and 18 disposed at the four corners of the base, and the rods terminate in lower ends 26. Positioning plates (23), (24) and (25) are secured to the lower ends 26 of three of the rods 13 by suitable means such as screws (not shown) to prevent the rods from moving upwardly out of the associated seats. The lower end 26 of the fourth rod 13 is connected to driven wheel 22 for rotation therewith. The bearing boards (11) each comprises four through-holes (29) at the four corners corresponding to the four through-holes (28) of the base (10), through which the shaped rods of the lower link rod assembly (13) or the upper link rod assembly (12) may be inserted. When respective rods are inserted through a bearing board (11), the middle vertical segments (27) are disposed in the through-holes (29). An upper fastening plate (30) each is mounted on the rods and set on the top of the through-holes (29) and a lower fastening plate (32) and a washer (31) each are respectively mounted on the rods and set on the bottom of the through holes (29). The upper fastening plate (30) and the lower fastening plate (32) each comprises a boring bore (33) or (34), through which a rod may insert, and a side bolt hole (35) or (36), through which a screw may be inserted to secure the fastening plate (32) or (31) to a rod which is penetrated therethrough. The connection of the rods of the upper link rod assembly (12) with the rods of the lower link rod assembly (13) are made through bushings (37). The bushings (37) each comprises two bolt holes (38) and (39), through which two screws may be inserted to secure the bottom vertical segment of a rod of the upper link rod assembly (12) and the upper vertical segment of a rod of the lower link rod assembly (13).

During operation, the rotation of the motor (20) drives the driving belt (21) to carry the driven wheel (22) to rotate concomitantly. During rotation of the driven wheel (22), the connected rod is simultaneously carried to rotate. Through the motion of the generally bow rod which is directly carried by the driven wheel (22), the bottom bearing board is simultaneously carried to change position horizontally.

As the bottom bearing board moves horizontally, the middle vertical segments of each of the four rods 13 are caused to move simultaneously in a horizontal direction by the bottom bearing board. Accordingly, the three rods 13 not connected to the driven wheel are caused by the lower bearing board to rotate in synchronism with the rod 13 which is connected to the driven wheel 22.

Figure 5:
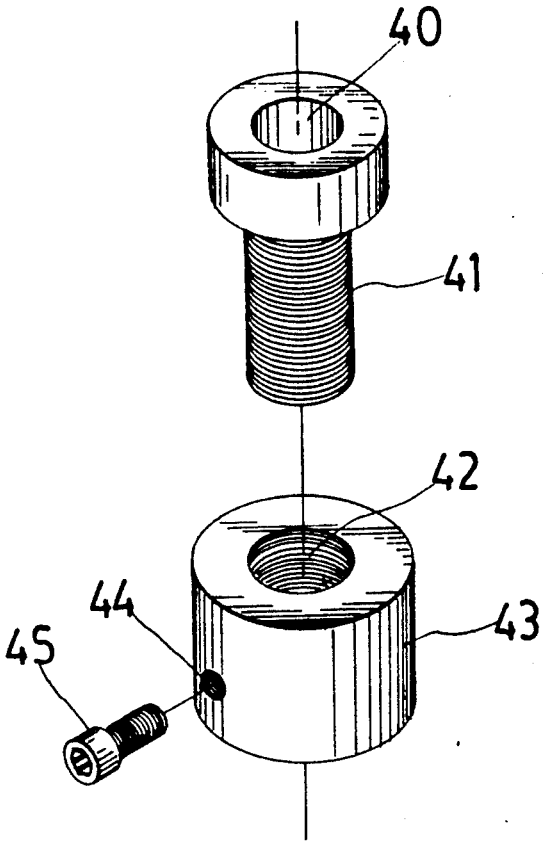
FIG. 5 illustrates an alternate form of bearing board fastening means.

FIG. 5, illustrates as an alternate form of bearing board fastening means to replace the upper fastening plate (30) and lower fastening plate (32), in which a screw bolt (41) which comprises a boring bore (40) is used to screw up with the vertical bolt hole (42) of a fastening plate (43) so as to secure a bearing board therebetween. The fastening plate (43) also comprises a side bolt hole (44) through which a bolt (45) is inserted to secure a generally bow shaped rod which is penetrated through the fastening plate (43).

I claim:

1. A moving display rack comprising, a base, drive means supported by said base, a plurality of elongated vertically extending generally bow shaped link rods each of which includes an upper end, a lower end and an intermediate portion, said intermediate portion being offset horizontally with respect to said upper and lower ends, the lower ends of each of said rods being rotatable supported by said base, means drivingly interconnecting said drive means with one of said rods to define a rotatable driven rod, a first bearing board interconnected between and supported at said upper ends of said rods with said upper ends being rotatable with respect to said first bearing board, a second bearing board interconnected between and supported at the intermediate portions of said rods with said intermediate portions being rotatable with respect to said second bearing board, fastening means for retaining said bearing boards in position longitudinally of said rods, so that rotation of said rotatable driven rod will cause horizontal movement of said second bearing board supported at the intermediate portion thereof, and such horizontal movement of said second bearing board carries the intermediate portions of the remaining rods through a similar horizontal movement to cause rotation of said remaining rods.

2. A moving display rack as defined in claim 3 wherein said upper and lower ends as well as said intermediate portion of each of said rods comprise straight segments of said rods.

3. A moving display rack as defined in claim 1 wherein said fastening means includes an annular fastening member surrounding one of said link rods above one of said bearing boards, and a second annular fastening member surrounding said last-mentioned link rod below said one bearing board to clamp said one bearing board between said annular fastening members, and screw means fixing said annular fastening members to said last-mentioned link rod.

4. A moving display rack as defined in claim 1, wherein said fastening means includes an annular sleeve having an internal thread, means to secure said sleeve to one of said rods, a screw bolt having an external thread received within said internal thread, said screw bolt including a central bore for receiving said one rod, said screw bolt having an enlarged head portion to clamp one of said bearing boards between said head portion and said sleeve.

* * * * *